United States Patent [19]

Calderon

[11] Patent Number: 4,604,165

[45] Date of Patent: Aug. 5, 1986

[54] APPARATUS FOR PROCESSING BULK MATERIALS BY INDUCTION

[76] Inventor: Albert Calderon, 1065 Melrose St., Bowling Green, Ohio 43402

[21] Appl. No.: 465,687

[22] Filed: Feb. 11, 1983

Related U.S. Application Data

[63] Continuation-in-part of Ser. No. 401,620, Jul. 26, 1982, abandoned, Ser. No. 229,317, Jan. 29, 1981, Pat. No. 4,389,283, Ser. No. 209,831, Nov. 24, 1980, Pat. No. 4,376,033, Ser. No. 166,172, Jul. 7, 1980, Pat. No. 4,494,984, Ser. No. 153,159, May 27, 1980, abandoned, and Ser. No. 131,137, Mar. 17, 1980, Pat. No. 4,464,197, said Ser. No. 229,317, is a continuation-in-part of Ser. No. 201,699, Oct. 29, 1980, abandoned, which is a continuation-in-part of Ser. No. 921,760, Jul. 3, 1978, abandoned.

[51] Int. Cl.[4] ..... C10B 1/04; C10B 19/00

[52] U.S. Cl. ..... 202/113; 48/65; 201/19; 202/227; 202/262; 373/142

[58] Field of Search ..... 202/113–115, 202/227, 228, 262; 201/19, 34, 39; 48/65, 202; 373/140, 149, 142

[56] References Cited

U.S. PATENT DOCUMENTS

| | | | |
|---|---|---|---|
| 1,758,524 | 5/1930 | Koppers | 201/34 |
| 1,973,913 | 9/1934 | Sperr | 201/39 |
| 2,094,946 | 10/1937 | Hubmann | 48/202 |
| 2,406,640 | 8/1946 | Siecke | 201/19 |
| 2,509,921 | 5/1950 | Gwynn | 373/140 |
| 3,948,640 | 4/1976 | Elvander et al. | 201/19 |
| 4,033,467 | 7/1977 | Bewley et al. | 202/262 |
| 4,288,294 | 9/1981 | Velling | 202/227 |

OTHER PUBLICATIONS

Perry; "Chemical Engineer's Handbook"; 4th Ed.; pp. 25-41, 25-42, 25-43; 1963.

*Primary Examiner*—Jay H. Woo
*Assistant Examiner*—Joye L. Woodard
*Attorney, Agent, or Firm*—Renner, Otto, Boisselle & Lyon

[57] ABSTRACT

An apparatus for processing bulk materials by induction wherein the materials are processed within a plurality of compartments whose walls comprise a material which is adaptable to being heated by induction and wherein the plurality of compartments commonly share an induction coil means which surrounds the plurality of compartments. The apparatus possesses features which make it adaptable to operate in a closed system to be acceptable to the environment and also features which guarantee uniform charging of the material to be processed and uniform discharging of the processed material. In applications where sulfur, tars and oils are a problem, means are provided to deal with such problems by reacting the sulfur and by cracking the tars and oils. The apparatus lends itself to economically process tonnages of great magnitude at a low operating cost and also it requires low investment cost.

29 Claims, 5 Drawing Figures

APPARATUS FOR PROCESSING BULK MATERIALS BY INDUCTION

CROSS-REFERENCE TO RELATED APPLICATIONS

This invention is a continuation-in-part of patent application Ser. No. 06/229,317 filed on Jan. 29, 1981, now U.S. Pat. No. 4,389,283 titled: "Method for Making Coke via Induction Heating." Application No. 06/229,317 is a continuation-in-part of application Ser. No. 201,699 filed Oct. 29, 1980, titled: "Method and Apparatus for Making Coke;", which is a continuation-in-part of application Ser. No. 921,760 filed on July 3, 1978, for: "Improved Method and Apparatus for Making Coke" which was refiled as a streamlined case on Sept. 25, 1980, bearing Ser. No. 190,607. Applications bearing Ser. Nos. 201,699, 190,607, and 921,760 are now abandoned. Also this invention is a continuation-in-part of patent application Ser. No. 06/401,620 filed July 26, 1982, titled "Method, Apparatus and Composition of Material for the Clean Usage of Carbonaceous Materials, " Application Ser. No. 401,620 has now been abandoned.

Further this invention constitutes a continuation-in-part of the following applications:

- Ser. No. 131,137 filed Mar. 17, 1980, now U.S. Pat. No. 4,464,197, titled "Method and Apparatus for Making Iron"; and
- Ser. No. 166,172 filed July 7, 1980, now U.S. Pat. No. 4,494,984, titled "Method and Apparatus for the Direct Reduction of Iron Oxide." This application is a continuation-in-part of application No. 131,137; and
- Ser. No. 153,159 filed May 27, 1980, now abandoned, titled "Method and Apparatus for Gasifying Coal" which was refiled as a streamlined case on Apr. 6, 1982, bearing Ser. No. 365,899, now U.S. Pat. No. 4,469,488, titled "Method and Apparatus for Gasifying Coal;" and
- Ser. No. 209,831 filed Nov. 24, 1980, now U.S. Pat. No. 4,376,033, titled "Method for Recovering Oil from Shale".

BACKGROUND OF THE INVENTION

The instant invention relates to apparatus for the processing of materials that heat poorly or none at all by induction. Specifically this applies to bulk materials such as any carbonaceous material as for example coal, coke, lignite, peat, shale, tar-sands, and also ores, lime, limestone, etc. In the processing of bulk materials tonnages of the greatest magnitude must be heated uniformly, efficiently and economically in an environmentally acceptable way. In today's practices, bulk materials are heated by a direct heating means using combustion such as in a blast furnace or in a direct-pyrolysis shale-retort, or by an indirect heating means such as the heating of refractories by burning of a fuel and by having the refractories in turn heat the bulk materials as is the case in a coke oven or in an indirect-pyrolysis of shale.

The problems associated with the direct heating means are pollution to the environment and difficulty in control, and the problems associated with the indirect heating means are inefficiency in heat transfer and a requirement of excessive capital investment. The present invention overcomes the above problems by providing a plurality of compartments whose walls comprise a material which is adaptable to being heated by induction and wherein said plurality of compartments commonly share an induction coil means which surrounds said plurality of compartments. The prior art of record against the aforementioned applications of the applicant fail to teach the structure of the applicant.

SUMMARY OF THE INVENTION

By way of example the following description will describe the apparatus with relation to its processing of coal but the same apparatus is also adapted to process the materials mentioned. The instant invention defines an apparatus possessing a plurality of compartments whose walls comprise a material which is adaptable to being heated by induction and wherein said plurality of compartments commonly share an induction coil means which surrounds said plurality of compartments and said induction coil means does not individually surround each of said compartments. The coal to be processed is charged into each individual compartment and the walls of each compartment in turn heat the coal contained within each compartment. The material of construction of the walls can be any material that is adaptable to being heated by induction such as graphitic, metallic, etc. The heat in the charge originates from the walls and travels inwardly into the charge. The apparatus can be operated as batch, semi-continuous or continuous. The compartments are made of such length as to make possible the processing of the coal carried out in such a way that by the time the coal reaches the opposite end from which it was charged, the coal is fully processed or coked to produce a metallurgical coke or a coke suitable for pulverization to be used as a fuel in a boiler or combustion chamber. By virtue of providing a plurality of compartments bunched together to form a cluster, the apparatus lends itself to a scale-up which is predictable because the size of each compartment is not increased but the number of compartments is increased, the same as is practiced in a steam boiler. As for example, when steam is made in three-inch diameter tubes in a boiler producing 100,000 pounds of steam per hour and it is decided to make a boiler to produce 500,000 pounds of steam per hour, the diameter size of the tubes remains three inches, but the number of tubes is increased proportionately. The instant invention is the same. This feature is very important because in installations costing scores of millions of dollars each, predictability is vital.

Some other features of the instant invention are the provisions of means for uniform charging and discharging, means to heat the walls of the compartments in zones, means to distribute the charge uniformly, means to collect the gases, means to clean the gases, means to cool the processed material prior to discharging, and means to guarantee the positive movement of the coal and coke within the apparatus.

Therefore, the main object of the instant invention is to provide an apparatus with a plurality of compartments, that efficiently processes coal by transferring heat from the walls of the compartments to the coal contained in the compartments in a completely closed system in order to comply with the Clean Air Act and OSHA standards.

Another object of the instant invention is to provide an apparatus that is conducive to scaling up to commercial sizes to satisfy the critical needs of industry.

Further, an object of the instant invention is to provide an apparatus that requires a relatively low capital investment for facilities to produce coke on a commercial scale.

Yet an object of the instant invention is to provide an apparatus that requires low maintenance and which is capable of overcoming the problems presented by the severe erosive properties of coal and coke.

Further another object of the instant invention is to provide an apparatus that furnishes heat by means of induction coil means surrounding a cluster of cells or compartments whose external walls are insulated in such a way as to force the heat to flow inwardly of the compartments so that the coal to be carbonized contained within each compartment is efficiently heated by the walls of each compartment.

Yet another object of the instant invention is to provide an apparatus wherein a plurality of heat zones are provided to selectively control the heat input into said compartments.

It is another object of the instant invention to provide an apparatus wherein the compartments contained therein are insulated and isolated from each other in such a way as to provide the uniform heating of each compartment independently of its adjacent compartment.

Still another object of this invention is to provide an apparatus wherein coal is distributed uniformly into each compartment contained in said apparatus in such a way as to provide a balance in the heating procedure in order to obtain a product that is uniformly coked.

It is therefore another object of the instant invention to provide an apparatus wherein provisions are made to guarantee the movement of coal and coke within each of said compartments by positively pushing the coal into each compartment and positively pushing the coke out of each compartment.

It is yet another object of the instant invention to provide an apparatus wherein provisions are made to efficiently preheat the coal before devolatilization.

It is further another object of the instant invention to provide an apparatus wherein provisions are made for the efficient recovery of the by-products of coal generated during carbonization.

Further yet another object of the instant invention is to provide an apparatus wherein provisions are made for the efficient heat recovery from the coke after carbonization for energy conservation.

Therefore, further another object of the instant invention is to provide an apparatus capable of making coke from lower grades of coal to supplant the dwindling reserves of oil and gas.

It is further yet another object of the present invention to provide an apparatus capable of desulfurizing the coal to overcome the ill effects of "acid rain".

It is therefore yet another object of the instant invention to provide an apparatus that is capable of cracking the tars and oils contained in the coal and produce a clean gas.

Other objects of this invention will appear from the following detailed description and appended claims. Reference is made to the accompanying drawings forming a part of this specification wherein like reference characters designate corresponding parts in the various views.

Figure 1:
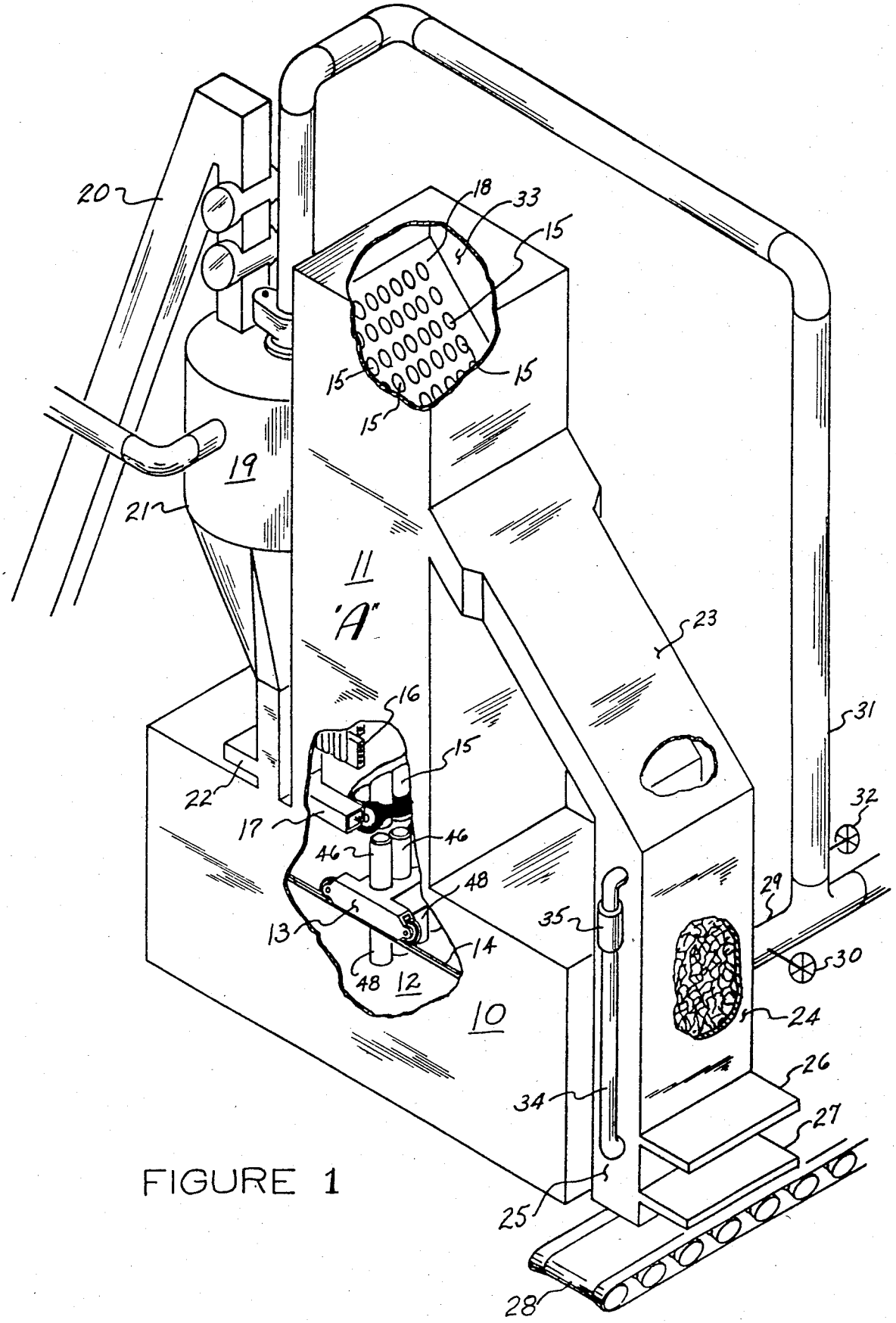
FIG. 1 is a schematic three-dimension drawing of the instant invention. It shows the coal delivery system, the charging car, the carbonizing shaft, the coke receiving chamber, the gas handling system, the coke quenching section, and the coke conveyor.

Before explaining in detail the present invention, it is to be understood that this invention is not limited to the details of construction and arrangement of the parts illustrated on the accompanying drawings, since the invention is capable of having other embodiments without departing from the spirit of the invention. Also it is to be understood that the phraseology or terminology herein set forth is for the purpose of description and not limitation.

DETAILED DESCRIPTION OF DRAWINGS

In FIGS. 1, 2, 3, and 5, reference letter "A" represents the retort in which processing of the materials as for example coal, takes place. Retort A, which takes the form of a vertical structure, possesses piers 10 upon which carbonizing shaft 11 is mounted which shaft is preferably located above ground in order to provide a clearance beneath it so as to provide a cellar-like arrangement denoted by numeral 12. Within cellar 12, charging car 13 is disposed on rails such as rail 14 in order to provide a runway for charging car 13. Shaft 11 is made up of a plurality of compartments such as compartment 15. The plurality of compartments are surrounded by induction coil means 16. Coil 16 surrounds the entire plurality of compartments bunched together to form a cluster of compartments with the plurality of compartments commonly sharing induction coil 16 and obviating the necessity of having individual induction coil surrounding each compartment such as compartment 15. The cluster of compartments is supported preferably on tube-sheet 17. Tube-sheet 17 is water-cooled in order to maintain its rigidity and be unaffected thermally. Above shaft 11 incline plane 18 is disposed in such a way as to permit the gravitational sliding of the coke from shaft 11, once the coke is pushed out of compartments 15.

Coal handling system 19 comprises conveyor delivery means 20, coal bunker 21 and discharge means 22. Charging car 13 is adapted to receive coal from bunker 21 and deliver it to compartments 15. An interconnecting slope denoted by 23 directs coke from inclined plane 18 to coke storage means 24. Beneath storage 24 quenching section 25 is located. Control valve means 26 feeds coke from storage 24 to quenching section 25. Control means 27 dispenses quenched coke from section 25 onto coke conveyor 28.

During coking, the raw gas leaves the top of shaft 11 and the gas is directed through coke storage 24 in order to crack the tars and oils contained in the gas and also absorb the sulfur which takes the form of $H_2S$ which is entrained in the raw gas leaving shaft 11. A gas handling system such as duct 29 is disposed to the bottom of coke storage 24 to take away the cleaned gas. Valve 30 controls the pressure within coke storage 24. In certain instances the hot gas leaving coke storage 24 may be used for drying and preheating the coal contained in coal bunker 21 and in such instance duct 31, equipped with valve 32, is provided to direct the gas from coke storage 24 to coal bunker 21. In cases wherein the coal is not dried, the moisture of the coal is entrained in the raw gas leaving the top of shaft 11 via plenum 33, located above incline 18. Such moisture, when coming in contact with hot coke in coke storage 24, is converted to water gas ($CO+H_2$). While quenching coke in section 25 the steam is directed by means of pipe 34 from quenching section 25 to the top of coke storage 24. Pressure valve 35 which preferably takes the form of a check valve, controls the flow of the steam resulting from the quench. Such steam when entering the top of coke storage 24 mixes with the raw gas and flows downwardly through the bed of coke contained within coke storage 24 and such steam is also converted to water gas.

Figures 2, 3:
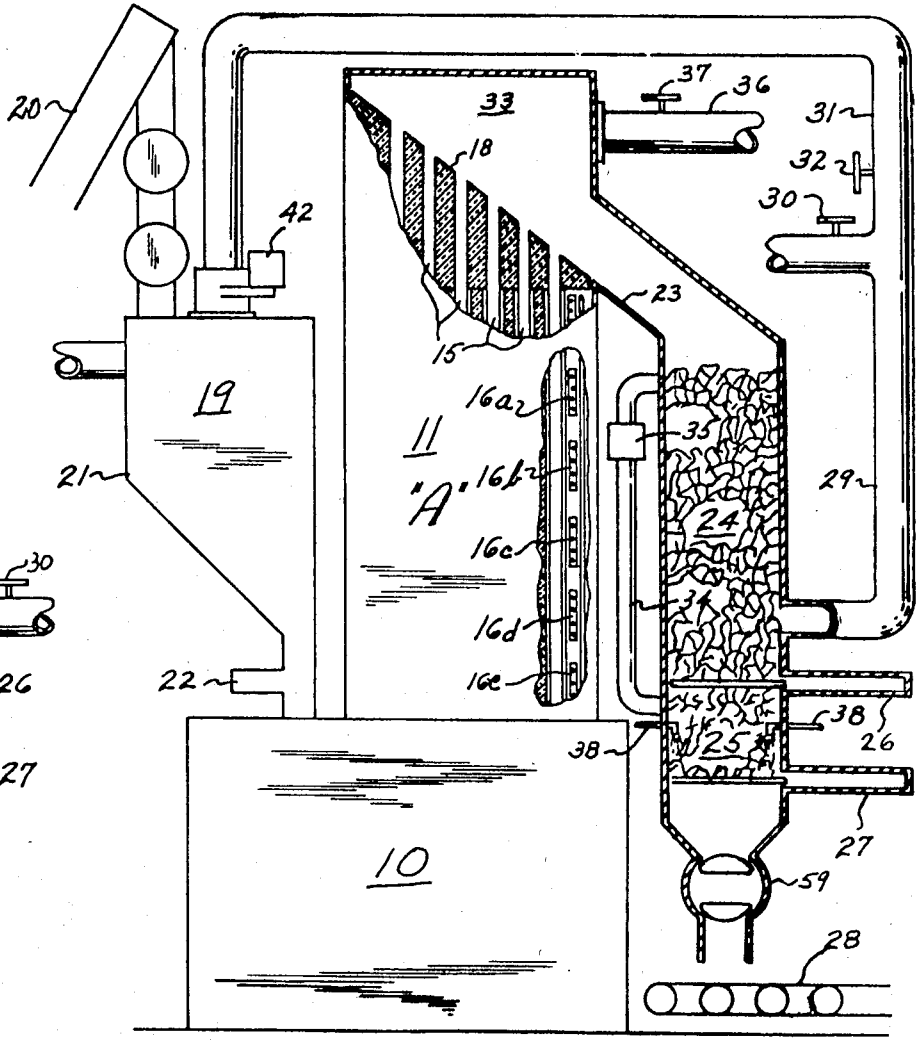
FIG. 2 is a side elevational view of the retort of FIG. 1. It shows the structure upon which the carbonizing shaft is erected. The coal bunker is to the left of the shaft and the coke receiving chamber to the right of the carbonizing shaft which takes the shape of a plurality of compartments surrounded by an induction coil means which is made in sections. The top of the carbonizing shaft takes the form of an inclined plane.
FIG. 3 is a side elevational view of the retort and it is similar to FIG. 2 except that the top of the carbonizing shaft is made flat and it is equipped with a scraper means for discharging the coke. It also shows the charging car and stirring means within the coal bunker for the drying of the coal.

Referring to FIG. 2, provision is made for the disposal of the raw gas without cracking if so desired. Duct means 36 equipped with valve 37 is provided to collect the raw gas and by pass the coke contained within coke storage 24. Such an arrangement is provided in instances where recovery of the tar and light oils is practiced. Preferably, induction coil 16 is made in sections and denoted as for example by 16*a*, 16*b*, 16*c*, 16*d*, etc. shown by FIG. 2. FIG. 2 also shows quenching means spray system 38 disposed within quenching section 25.

Referring to FIG. 3, scraper 39 equipped with blade 40 is disposed above the plurality of compartments 15 and is employed to scrape the coke from the top of compartments 15 and into coke storage 24. When using gas from coke storage 24 to preheat coal in bunker 21, gas distribution means 41 within bunker 21 is used. Such distributing means preferably is a revolving kind and the revolution of means 41 is imparted by drive 42. Distributing means 41 is equipped with outlet holes 43 disposed in paddles 44.

Figure 4:
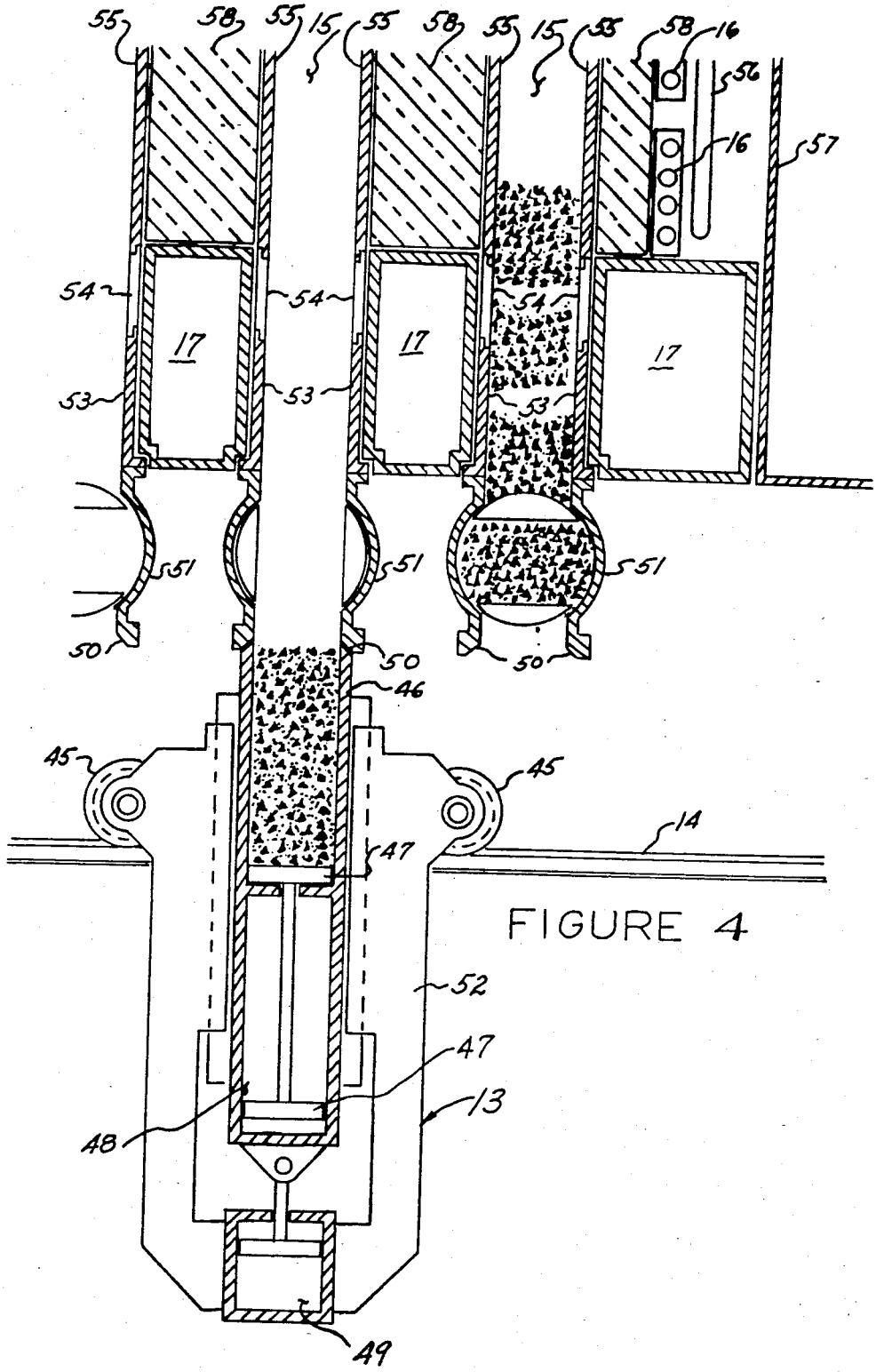
FIG. 4 is an enlarged partial section showing coal being pushed into a compartment within which the coking of the coal takes place.

In a preferred structure for the charging of coal into compartments 15 by means of charging car 13, reference is made to FIG. 4 which shows details of charging car 13. Car 13 runs on rails 14 (second rail 14 not shown); it is made in the form of a crane running on track wheels 45 and equipped with a plurality of magazines such as magazine 46 within which coal is contained for injection into compartments 15. Magazine 46 is equipped with plunger 47 which is preferably hydraulically actuated within cylinder 48. Cylinder 48 in conjunction with magazine 46 are adapted to be raised and lowered by actuator 49 in order to make the rim of magazine 46 to mate with valve seat 50. Seat 50 is the chamfered portion of valve 51 which controls the charge in compartments 15. Charging car 13 possesses structural frame 52 to provide a housing for the plurality of magazines such as magazine 46, to conform to a row of compartments, such as compartment 15. Such a mobile structure as provided by charging car 13 makes possible the receipt of the coal from bunker 21 and the delivery of same to compartments 15; such an arrangement provides a pollution-free charging system.

Compartment 15 is preferably made of metallic sleeve 53 which is disposed to tube-sheet 17; insulator 54 disposed above metallic sleeve 53 and graphite tube 55 which may be made in sections, and possesses properties as to make it adaptable being heated efficiently by induction coil means 16. Shunt 56 is provided to absorb the magnetic flux and prevent the overheating of shell 57. Shell 57 surrounds the entire plurality of tubes and is mounted in such a way as to provide a gas-type envelope. Insulation 58 is disposed between compartments 15 in order to preferably insulate compartments 15 from each other both thermally and electrically. Valve 51, which is mounted to the bottom of each compartment 15 is preferably made of the ball valve type with a full bore in order to give positive closure and also to minimize interference during coal injection into compartments 15.

Figure 5:
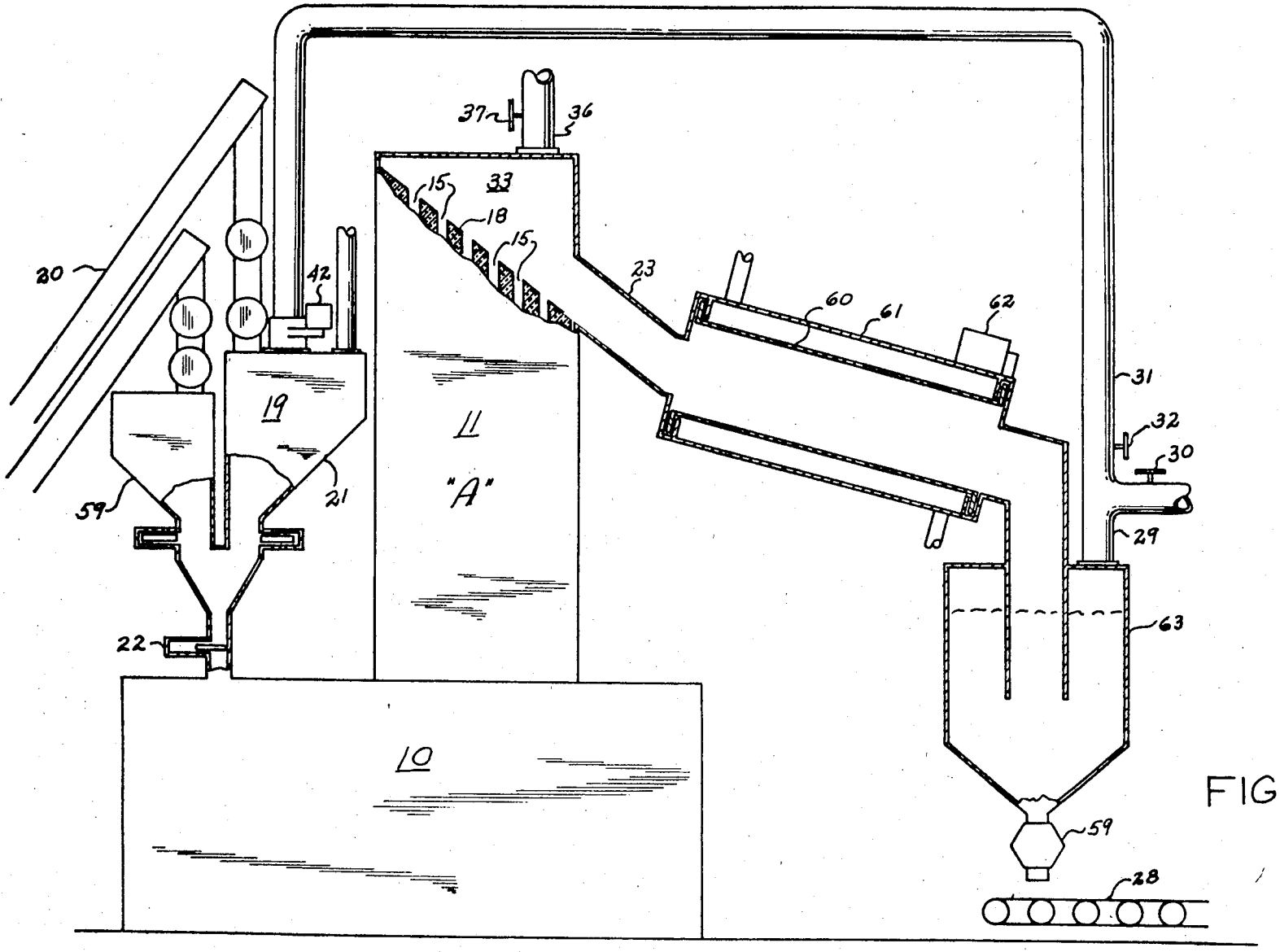
FIG. 5 is a side elevational view of the retort. It shows the coal and desulfurizer combined handling system, carbonizing shaft, dry-quenching means for the indirect removal of heat from the hot coke and for conserving the heat energy contained in the coke, final quenching means and gas means for handling the gases evolved during carbonization of the coal.

Referring to FIG. 5, coal bunker 21 is accomodated with combination hopper 59 in order to provide in certain instances a desulfurizing agent such as limestone or lime to mix with the coal prior to carbonization. This is particularly used when carbonization of high sulfur coals takes place. In the dry quenching of coke shown by FIG. 5, preferably a revolving drum 60 housed in a gas-tight shell 61 is provided. The cooling of the coke takes place by circulating water between revolving drum 60 and stationary shell 61. Clean steam is generated between drum 60 and shell 61. Drive 62 is provided to impart rotary motion to drum 60 of the quencher. If necessary a final quench takes place within immersion quencher 63. If the right proportions of coal and CaO (or $CaCO_3$) are used and both heated to about 2200° C., $CaC_2$ (calcium carbide) can be made with the instant apparatus. It is also important to state that the instant apparatus is not only suitable for processing solids, it can also process liquids and gases.

While the operation of the apparatus of the present invention may be comprehended from study of the foregoing description, it is believed that the operation may be further explained as hereinafter set forth.

Operation

By way of example, the operation describes the processing of coal to make coke. Referring to the drawings and assuming that retort A is in the process of coking, charging car 13 travels to coal bunker 21 and magazines 46 register with the bottom of bunker 21. By means of control valve 22, coal is fed into magazines 46 and in this manner magazines 46 are filled. Car 13 then travels to carbonizing shaft 11 and registers with a row of compartments 15 and by means of actuator 49 magazines 46 seat against chamfered flange 50 of ball valve 51 as shown in FIG. 4. Ball valve 51 opens and plunger 47 pushes coal into compartment 15; once the charge is injected into compartment 15, ball valve 51 closes. Upon the return of plunger 47 into magazine 46 both magazine 46 and cylinder 48 are dropped by means of actuator 49 and charging car 13 is in a position to fetch another charge of coal from bunker 21. While the coal is pushed into compartment 15, great compressive forces are developed by virtue of pushing the entire column of the coal and the coke contained in each compartment. Such compressive forces are useful for the development of strong and stable coke. Upon injection of coal into compartment 15, coke is discharged from the top of compartments 15 and spilled onto incline 18 from which the coke slides into coke storage 24 via interconnecting slope 23.

Since walls 55 of compartments 15 are made of a material that is adaptable to being heated by induction, the heat from the walls heat the coal and the coal, in turn, gives up its volatile matter; upon devolatilization of the coal coke is produced. The volatile matter contains gas, tars, light oils, moisture, ammonia and such volatile matter rises in compartments 15 and leaves the top of carbonizing shaft 11 into plenum 33. If the gas is to be used without cracking, the gas leaves retort A via duct 36, controlled by valve 37 shown in FIGS. 2 and 3. If the volatile matter or raw gas is to be cracked, the gas is forced to filter through a bed of coke contained in coke storage 24. Coke storage 24 is made of such height as to contain enough hot coke and at such temperature to break up any moisture from the coal to convert it to water gas and also to crack all the hydrocarbons contained in the gas to result in a clean gas leaving coke storage 24 via duct 29, such cracking temperature averages 1800° F. Periodically valve 26 opens to discharge some coke into quenching section 25 in which the coke is quenched by means of water or steam delivered by spraying system 38. Pressure within quenching section 25 increases upon the expansion of the steam and the steam is preferably directed by means of pipe 34 via checker valve 35 to discharge it into the top of coke storage 24. Such steam, which is dirty and containing phenol, cyanide, etc., mixes with the raw gas in the top of carbonizing shaft 11 and the mixture of gases is forced to filter downwardly into and through the hot coke for cracking. Such cracking breaks most of thehydrocarbons to result in a clean gas with a yield of about 90 percent CO and $H_2$ of which the $H_2$ is about double the CO. Once the temperature of the coke in quenching chamber 25 cools to a temperature that it can be handled in the atmosphere without pollution, the quenched coke is discharged onto conveyor belt 28 by means of valves 27 and 59.

In the event that the gas leaving coke storage 24 which is hot, is to be used for drying and preheating the coal, the gas is directed to coal bunker 21 via duct 31, controlled by valve 32. The hot gas entering coal bunker 21 is distributed within the coal by rotary distributor 41, driven by driving train 42. Distributor 41 possesses paddles 43 which are equipped with vents 44; this is shown on FIG. 3.

Compartments 15 are preferably made to possess a uniform height and be crowned with refractory to be used as incline 18. Scraper 39, equipped with blade 40, shown on FIG. 3, may be used instead of incline 18.

Since it is contemplated to use a material that is adaptable to being heated by induction for compartment walls 55, and such material must withstand a very high temperature, graphite is a sensible material to use. However, since moisture in the coal may affect the life of graphite, sleeve 55 which is made from a material unaffected by steam such as silicon carbide is interposed between the graphite and mounting metallic sleeve 53 to serve a dual purpose:

(1) to insulate electrically the graphite walls from touching any metallic surfaces; and (2) to initially heat the coal that is contiguous to the walls of compartment 15 and thereby drive the moisture away from the hot walls of the graphite and towards the inward portion of the charge contained within compartment 15.

Of course it is possible to line graphite walls 55 with a coating or liner that is not affected by steam to protect the graphite. Since graphite walls 55 do not have as much strength as cold metal such as steel, metallic sleeve 53 is used to mount the entire assembly of insulator 54 and graphite 55, which assembly is disposed to tube-sheet 17.

It is preferred to operate each compartment separately by having a separate ball valve for each compartment 15 whereas the valve 51 may be operated in unison. The initial heating of the coal takes place within insulator 54 by virtue of the walls of insulator 54 not being heated by conduction, but by conduction by virtue of contacting graphite walls 55. As shown in FIG. 4, coil 16 is located above insulator 54. The coal contained within compartment 15 keeps ascending within each compartment caused by the injection of fresh coal from the bottom of shaft 11. Coke is discharged at the top of shaft 11 simultaneous with such injection. While the coal is ascending, walls 55 of compartment 15 are heated by induction and these walls, in turn, heat the coal contained within compartments 15. The coal, upon entering the zones of induction coil **16*e*, 16*d*, 16*c*, 16*b*, and 16*a*, is effectively heated in such a way that the coal is fully devolatilized and made into a coke by the time the coke reaches the top of carbonizing shaft 11. Initially the coal that is contiguous to walls 55 is heated because of close contact with the red-hot walls 55 of compartment 15 and as this coal is devolatilized, the heat from the walls pushes the volatiles toward the center of each cell. Such volatiles directed toward the center of each cell cause fissures in the coal. Depending upon the coking characteristics of the coal, the coke may be chunky or it may be small in size. The temperature of coking also determines the size of coke produced. By providing a positive, upward, compressive force to move the coal and coke, the properties of the coal do not make any difference, be it a caking or noncaking coal. The instant apparatus will handle any kind of coal. To enhance the heating in carbonizing shaft 11, insulation 58 is interposed between compartments 15 in order to prevent any heat from leaving each compartment through walls 55 of compartment 15. This results in a very efficient heat transfer system, and all this takes place within each compartment 15** and independently of each other, so that each compartment does its intended heating without being affected by gas channelling, short circuiting, arc-ing or bridging.

By employing control valve 30, the pressure within coke storage 24, plenum 33 and carbonizing shaft 11 is adjusted and maintained to a selective pressure. The selection of such pressure is useful in controlling the methane content in the gas and also in having pressurized gas leaving retort A without using a compressor.

The gases of devolatilization which mainly comprise hydrogen and methane leave plenum 33 and may be processed by conventional means as practiced in a by-product plant or they may be cracked by means of the bed of hot coke contained in coke storage 24. In controlling the power input into coils 16*a*, 16*b*, 16*c*, 16*d* and 16*e*, the coal is heated in zones in order to provide maximum control within the apparatus.

It is to be noted that with a cluster of compartments such as compartment 15, bunched together, results in great productivity at a low operating cost and minimum investment are obtained and also providing a fast-acting unit that will process materials including solids, liquids and gases in a closed system which will comply with EPA and OSHA. In years gone by, quenching of coke in a tower was a good way of disposal of contaminated water but with the clean air act such disposal in recent years has been outlawed. The disposal of such water as well as other chemicals has become a very serious problem to operators. The instant invention makes possible the disposal of contaminated water by quenching the hot coke and directing such contaminated steam through a hot filter bed of coke to cause such dirty steam to be converted to useful fuel, mainly water gas, and crack any hydrocarbons contained in such dirty steam.

It is to be noted that the coal introduced into the apparatus be it wet or dry, only two streams leave the apparatus; namely, clean gas and dry coke. An apparatus that does not discharge streams which need to be disposed of is of great importance to industry. This capability is of great importance to the operators and to the environment. Also it is to be noted that in the event hot gas is used to dry the coal, the moisture in the coal after being condensed is directed to sprays 38 of quenching section 25 in order to prevent disposal streams. Further it is to be noted that the structure of the instant invention makes possible the ease of replacement of compartments 15 by having such compartments individually secured to tube-sheet 17 and in this manner provide an apparatus that is easily maintainable.

From the foregoing detailed disclosure, it is evident that the instant apparatus is a contribution of great significance to the art of processing bulk materials, including coal for the making of metallurgical as well as non-metallurgical coke in a continuous, semi-continuous or batch operation. Further, the instant apparatus has a potential of producing energy in the form of clean, medium BTU gas and coke from cheaper, high sulfur coals by combining a desulfurizer such as lime or limestone with the coal and feeding such mixture into carbonizing shaft 11. Since the residence time of the coal to convert to coke extends several hours in duration, ample time is provided for this apparatus to have the sulfur react with the calcium in the limestone or lime, this being shown in FIG. 5. FIG. 5 also shows that the coke may be dry quenched such as in a rotary drum.

Besides having the limestone or lime used as a desulfurizer, if the mixture of the limestone or lime with the coal is of such proportions as required for making $CaC_2$, the instant apparatus is capable of doing so and in so doing, $CaC_2$ can be used for the economical manufacture of acetylene. In addition to the making of coke and gas, the instant invention would improve the environment, eliminate hazards to workers in coke plants, improve the balance of payments, reserve capital, and improve profit. In fact, the instant invention is of such significance that when analyzed from the standpoint of an energy producing source, it can be said that this invention produces as a main product energy in the form of gas and coke. All in all, it is submitted that the present invention provides a new and useful apparatus for processing bulk materials in the form of solids and also it can handle liquids, gases, including toxics which industry badly needs to dispose of.

I claim:

1. Apparatus for the processing of a material that heats poorly or not at all by induction comprising the following:

(a) means for charging said material;

(b) a plurality of adjacent tubular comaprtments whose walls are formed of a substance which is capable of being heated directly by induction, each compartment defining therewithin a space for receiving a charge of said material;

(c) insulating means immediately surrounding the walls of each adjacent compartment, said insulating means being formed of a (substance that does not heat by induction;

(d) induction coil means surrounding said plurality of compartments with said plurality of compartments commonly sharing said induction means and said induction coil means not individually surrounding any of said compartments, said induction coil means directly heating the walls of said compartments while said walls in turn effect the heating of said material contained within said compartments; and (e) means for discharging said material from said plurality of compartments.

2. The apparatus as set forth in claim 1 wherein said means for charging said material is further characterized by means to charge said material without causing pollution to the environment.

3. The apparatus as set forth in claim 1 wherein said means for charging said material is further characterized by means to distribute said material into said plurality of compartments in such a way as to have substantially the same amount of material delivered to each compartment of said plurality of compartments.

4. The apparatus as set forth in claim 1 further characterized by means to press the material charged into each compartment of said plurality of compartments in order to press the material within each compartment.

5. The apparatus as set forth in claim 4 wherein said means to press the material charged into each compartment is further characterized by means to apply mechanical force to the surface of the material contained at one end of each compartment to press the material into said compartment and cause the movement of the contents contained within each compartment by compression.

6. The apparatus as set forth in claim 5 further characterized by means to force processed material out of the other end of each compartment as material to be processed is pressed into said one end of the compartment.

7. The apparatus as set forth in claim 6 further characterized by means for controlling the amount of material to be processed by pressing into one end of each compartment and by means for controlling the amount of processed material discharged out of the other end of each compartment.

8. The apparatus as set forth in claim 1 wherein said means for charging said material is further characterized by means to press said material into each compartment of said plurality of compartments in order to cause the upward movement of said material within each compartment by compression.

9. The apparatus as set forth in claim 8 wherein said means to press said material into each compartment is further characterized by means to develop a mechanical force in the upward direction substantially across the surface of said material contained within each compartment to compact said material upwardly in order to cause the movement thereof by compression.

10. The apparatus as set forth in claim 8 wherein said means to press said material into each compartment in order to cause the upward movement of said material is further characterized by means having a stroke of sufficient length to cause the discharge of said material from each compartment.

11. The apparatus as set forth in claim 10 wherein said means to press said material into each of said compartments and discharge same from each compartment is further characterized by means to control the amount of material pushed into each compartment and the amount of material pushed out of each compartment.

12. The apparatus as set forth in claim 1 further characterized by means to collect gases resulting from the heating of said material.

13. The apparatus as set forth in claim 1 further characterized by means to make said apparatus operative on a semicontinuous basis.

14. The apparatus as set forth in claim 1 further characterized by means to make said apparatus operative on a continuous basis.

15. The apparatus as set forth in claim 1 further characterized by means to make said apparatus operative on a batch basis.

16. The apparatus as set forth in claim 1 is further characterized by means to cool said material after the discharge thereof from said plurality of compartments.

17. The apparatus as set forth in claim 16 wherein said means to cool said material is further characterized by means to dry-quench said material.

18. The apparatus as set forth in claim 16 wherein said means to cool said material is further characterized by means to spray water on said material.

19. The apparatus as set forth in claim 12 further characterized by means to dry and preheat said material with at least some of the gases resulting from the heating of said material.

20. The apparatus as set forth in claim 12 further characterized by means to treat the gases resulting from the heating of said material.

21. The apparatus as set forth in claim 20 wherein said material is a material which contains hydrocarbons and said means to treat the gases resulting from the heating of said material comprises means to crack at least some of the hydrocarbons contained in said gases.

22. The apparatus as set forth in claim 12 wherein said means to collect gases resulting from the heating of said material is further characterized by means to maintain the temperature of said gases to prevent the condensation of tar.

23. The apparatus as set forth in claim 1 further characterized by control means to maintain pressure within said apparatus to generate methane.

24. The apparatus as set forth in claim 23 wherein said control means to maintain pressure to generate methane is further characterized by control means to maintain the temperature of said apparatus to substantially prevent cracking of the methane.

25. The apparatus as set forth in claim 12 wherein said means to collect gases resulting from the heating of said material is further characterized by means adapted to collect the gases from the top of said apparatus.

26. The apparatus as set forth in claim 12 wherein said means to collect gases resulting from the heating of said material is further characterized by means adapted to collect gases resulting from quenching said material in addition to said gases resulting from the heating of said material.

27. The apparatus as set forth in claim 12 wherein said means to collect gases resulting from the heating of said material is further characterized by means to control the collection of said gases in order to operate said apparatus under positive pressure.

28. The apparatus as set forth in claim 27 wherein said means to control the collection of said gases in order to operate said apparatus under positive pressure is further characterized by means to envelope said apparatus externally in order to contain the gases within said apparatus and prevent pollution.

29. The apparatus as set forth in claim 1 wherein said induction coil means is further characterized by means to control the heat input into said compartments in such a way as to cause the heating of said compartments zonally.

* * * * *